US010170819B2

(12) United States Patent
Kim et al.

(10) Patent No.: US 10,170,819 B2
(45) Date of Patent: Jan. 1, 2019

(54) RFID ANTENNA STRUCTURE

(71) Applicants: Jungmin Kim, Shenzhen (CN); Jihyun Choi, Shenzhen (CN)

(72) Inventors: Jungmin Kim, Shenzhen (CN); Jihyun Choi, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 223 days.

(21) Appl. No.: 15/005,059

(22) Filed: Jan. 25, 2016

(65) Prior Publication Data

US 2016/0380332 A1 Dec. 29, 2016

(30) Foreign Application Priority Data

Jun. 23, 2015 (CN) ..... 2015 1 0351627

(51) Int. Cl.
*H01Q 1/24* (2006.01)
*H01Q 1/22* (2006.01)
*H01Q 7/06* (2006.01)

(52) U.S. Cl.
CPC ..... *H01Q 1/2208* (2013.01); *H01Q 1/243* (2013.01); *H01Q 7/06* (2013.01)

(58) Field of Classification Search
CPC ..... H01Q 1/2208; H01Q 1/24; H01Q 1/243; H01Q 1/48; H01Q 7/06
USPC ..... 343/788
See application file for complete search history.

(56) References Cited

U.S. PATENT DOCUMENTS

2009/0098827 A1* 4/2009 Koyama ..... H01Q 1/243 455/41.2
2012/0091821 A1* 4/2012 Kato ..... H01Q 1/38 307/104
2012/0306714 A1* 12/2012 Yosui ..... H01O 1/2208 343/788
2013/0075477 A1* 3/2013 Finn ..... G06K 19/07794 235/492
2013/0307746 A1* 11/2013 Nakano ..... H01Q 1/2225 343/850

* cited by examiner

*Primary Examiner* — Hoang V Nguyen
(74) *Attorney, Agent, or Firm* — Na Xu; IPro, PLLC

(57) ABSTRACT

A RFID antenna structure is disclosed. The RFID antenna structure includes: a metal back cover; a circuit board located below the metal back cover, the circuit board including a base plate and a ground plate overlaid on the base plate; a RFID chip mounted on the base plate; match circuits connected electrically with the RFID chip and located on the base plate; and an antenna coil connected electrically with the match circuits and located between the circuit board and the metal back cover. The metal back cover includes a top cover and a middle cover separated from the top cover by a slit, the antenna coil is located at least partly inside an area of the top cover, and the antenna coil is connected inductively with the top cover and/or the middle cover.

6 Claims, 2 Drawing Sheets

RFID ANTENNA STRUCTURE

FIELD OF THE INVENTION

The present invention discloses a mobile phone antenna, particular to a RFID antenna structure.

DESCRIPTION OF RELATED ART

Today, mobile devices with metal back cover are more and more popular. With the development of mobile technologies, the RFID (Radio Frequency Identification) technology has been widely applied to various mobile devices. Mobile devices with metal texture are more and more popular.

But there are some problems of the RFID technology in metal environment. The RFID antenna structure in some related technologies include a RFID antenna coil. The RFID antenna coil is placed usually between the metal back cover and battery or the PCB. As the metal back cover, battery or the PCB (partial or complete) are made of metal, the magnetic field produced by the RFID antenna coil after being energized interacts with these metal parts to produce eddy current. The eddy current hinders data transmission of the RFID antenna coil. It is necessary to introduce one kind of material with high resistivity to guide away the magnetic field from these metal parts after the RFID antenna coil is energized. Ferrite can realize this function, but the combination between the RFID antenna coil and the ferrite doesn't work very well in an environment of full metal housing.

With the development of technology, it is found that the slits on the metal back cover can solve the problems above. The RFID antenna is placed on a metal back cover and coupled respectively with the metal back cover on both sides of the slit. Even a capacitor is introduced between the RFID antenna coil and the metal back cover which is coupled with the antenna coil so as to improve the performance of the RFID antenna structure. But capacitive coupling is conditional, for instance, the position of the capacitive coupling and the structure performance of this RFID antenna structure are not optimal.

Therefore, it is necessary to provide a new RFID antenna structure to overcome the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
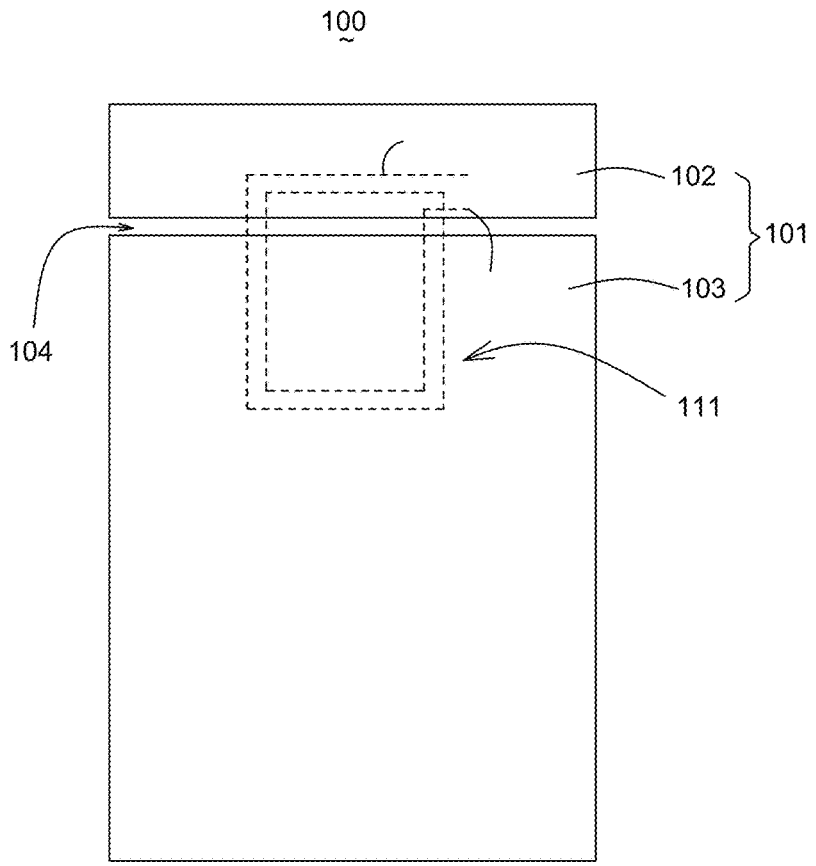
FIG. 1 is an illustrative front view of a RFID antenna structure in accordance with an exemplary embodiment of the present invention.
Figure 2:
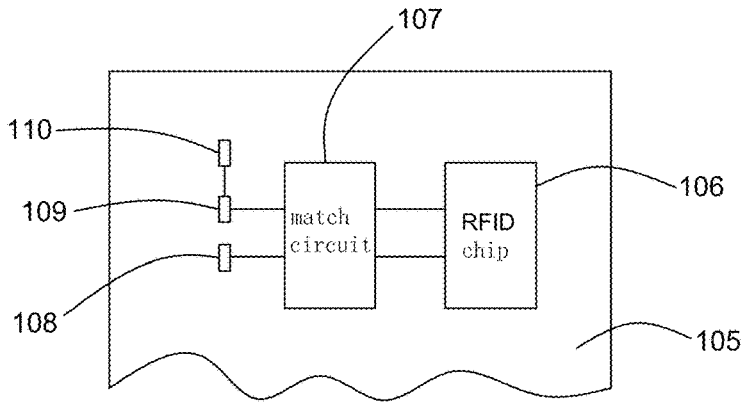
FIG. 2 is an electricity diagram of the RFID antenna structure in FIG. 1.
Figure 3:
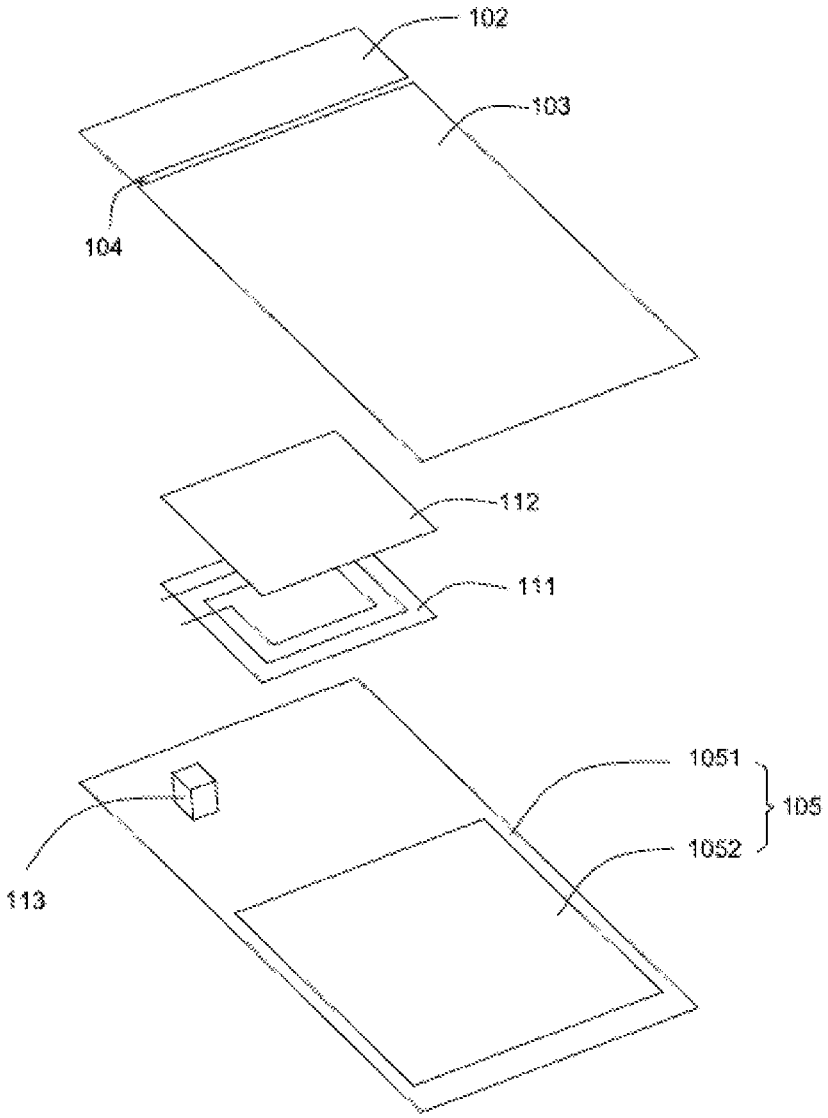
FIG. 3 is an isometric and exploded view of the RFID antenna of the present invention.

As shown in FIGS. 1-3, a RFID antenna structure 100, in accordance with an exemplary embodiment of the present disclosure, includes a metal back cover 101, a circuit board 105 located below the metal back cover 101, an antenna coil 111 located between the metal back cover 101 and the circuit board 105. Usually, in order to reduce the eddy current effect of the antenna coil 111 in metal environment, in case data transmission of the RFID antenna structure is blocked up by the eddy current, a ferrite 112 is installed between the antenna coil 111 and the metal back cover 101. The antenna coil 111 is affixed on the surface of the ferrite 112 toward the circuit board 105. The antenna coil 111 is arranged such that the direction of the axis around which the antenna coil 111 is disposed is parallel or substantially parallel to the direction perpendicular or substantially perpendicular to the metal back cover 101.

The metal back cover 101 includes a top cover 102 and a middle cover 103. The top cover 102 and the middle cover 103 are separated by a slit 104. The circuit board 105 includes a base plate 1051 and a grounding plate 1052 overlaid on the base plate 1051. As shown in FIG. 2, the RFID antenna structure 100 further includes a RFID chip 106 on the base plate 1051 and a match circuit 107 connected electrically with the RFID chip 106. Two ends of the antenna coil 111 are respectively connected electrically with a first contact point 108 and a second contact point 109 located on the circuit board 105.

In a selected embodiment of this disclosure, the circuit board 105 is further provided with a third contact point 110. A resistor or an inductance is provided between the second contact point 109 and the third contact point 110. The third contact point 110 is connected electrically with the top cover 102 and/or the middle cover 103. The top cover 102 and/or the middle cover 103 serve as an antenna radiator now. In this way, the antenna coil 111 is connected inductively with the top cover 102 and/or the middle cover 103. Because the area of the middle cover 103 is larger than the area of the top cover 102, the performance when the antenna coils 111 is coupled inductively with only the middle cover 103 is better than the performance when the antenna coil 111 is coupled inductively only with the top cover 102. Secondly, the third contact point 110 and the second contact point 109 may not be provided a resistor or an inductance also. The antenna coil 111 is electrically connected directly with the top cover 102 and/or the middle cover 103 via a conductor 113 connecting to the third contact point 110.

It is worth to be noticed here that, as a radiator, the top cover 102 and/or the middle cover 103 should better not be connected electrically with the grounding plate of the circuit board 105, and shall be kept to be disconnected with the grounding plate. Otherwise, the performance of the RFID antenna structure will be undermined seriously.

In addition, the position of the third contact point 110 is arbitrary on the circuit board 105. In other words, the antenna coil 111 can be connected inductively with the top cover 102 and/or the middle cover 103 at any position. As shown in FIG. 1, the antenna coil 111 is connected electrically with the top cover 102 at a position rather than at the endpoint, and connected electrically with the middle cover 103 at endpoint (fine solid lines indicate respectively the antenna coil 111 is connected electrically with the top cover 102 and the middle cover 103 in FIG. 1).

The antenna coil 111 of the RFID antenna structure is connected inductively with the top cover 102, as a radiator, and/or the middle cover 103, so the radiation performance of entire RFID antenna structure is improved.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A RFID antenna structure, including:

a metal back cover;

a circuit board located below the metal back cover, the circuit board including a base plate and a ground plate overlaid on the base plate;

a RFID chip mounted on the base plate;

match circuits connected electrically with the RFID chip and located on the base plate;

an antenna coil connected electrically with the match circuits and located between the circuit board and the metal back cover; wherein the metal back cover includes a top cover and a middle cover separated from the top cover by a slit, the antenna coil is located at least partly inside an area of the top cover, and the antenna coil is connected inductively with the top cover and/or the middle cover.

2. The RFID antenna structure as described in claim 1, wherein the top cover and/or the middle cover are separated from the grounding plate.

3. The RFID antenna structure as described in claim 2, wherein the antenna coil is coupled inductively with the top cover and/or the middle cover through a resistor or an inductance on the base plate, one end of the resistor or the inductance is connected electrically with the antenna coil, and another end is connected electrically with the top cover and/or the middle cover.

4. The RFID antenna structure as described in claim 3 further including a ferrite located between the antenna coil and the metal back cover, and the antenna coil is affixed on the ferrite.

5. The RFID antenna structure as described in claim 2, wherein the antenna coil is connected inductively with the top cover and/or the middle cover through a conductor.

6. The RFID antenna structure as described in claim 1, wherein the antenna coil is arranged such that the direction of the axis around which the antenna coil is disposed is parallel or substantially parallel to the direction perpendicular or substantially perpendicular to the metal back cover.

* * * * *